United States Patent [19]

Widerby

[11] Patent Number: 4,512,356

[45] Date of Patent: Apr. 23, 1985

[54] EXHAUST AIR VALVE

[75] Inventor: Lennart Widerby, Jonkoping, Sweden

[73] Assignee: Flakt Aktiebolag, Nacka, Sweden

[21] Appl. No.: 461,039

[22] Filed: Jan. 26, 1983

[30] Foreign Application Priority Data

Jan. 29, 1982 [SE] Sweden ..... 8200487

[51] Int. Cl.[3] ..... F16K 13/04

[52] U.S. Cl. ..... 137/75; 251/298; 98/1

[58] Field of Search ..... 251/305, 298; 137/77, 137/75; 98/1

[56] References Cited

U.S. PATENT DOCUMENTS

| | | | |
|---|---|---|---|
| 2,665,714 | 1/1954 | Greenwood | 137/77 |
| 3,726,308 | 4/1973 | Eberhardt | 251/298 |
| 4,241,748 | 12/1980 | McCabe | 137/77 |

FOREIGN PATENT DOCUMENTS

| | | | |
|---|---|---|---|
| 2503022 | 8/1975 | Fed. Rep. of Germany | 98/1 |
| 113130 | 3/1968 | Norway . | |
| 67562 | 3/1928 | Sweden . | |

*Primary Examiner*—Martin P. Schwadron
*Assistant Examiner*—Sheri Novack
*Attorney, Agent, or Firm*—Dann, Dorfman, Herrell & Skillman

[57] ABSTRACT

An exhaust air valve for placement in a ventilation conduit through which air is exhausted from a space to be ventilated. The valve has a casing with a concave seat surface facing upstream of the flow through the conduit and having a central valve orifice. A convex valve element cooperates with the seat surface and when the valve is closed engages the seat surface along a line of contact surrounding the seat. The curvature of the respective surfaces is the same, at least along the line of contact to ensure a tight closure of the orifice by the valve body. When opening, the valve body slides along the curved surface and the upstream surface of the valve body exposed to the flow is also convex to guide the flow toward the center of the orifice. Several embodiments are illustrated including valves with cords for remotely controlling the valve and heat-sensitive tripping mechanisms which automatically close the valve in the event of a rise in temperature above a preset level. The closing movement may be pivotal about a pivotal connection maintaining the valve element in sliding contact with the valve seat or may be a sliding displacement longitudinally of a slot in one of the elements.

16 Claims, 17 Drawing Figures

3
6-2; 7-2; 11-2
3-2
10
4
2-2
4
1
9-2
5
30
8
13-2
12

3
6-3; 7-3; 11-3
10
3
4
4
2-3
1
9-3
5
30-3
8
13-3
12

EXHAUST AIR VALVE

FIELD OF THE INVENTION

The present invention relates to valves for ventilation systems and in particular to an exhaust valve for air which is sucked out of or forced from a space to be ventilated.

BACKGROUND OF THE INVENTION

Exhaust air valves previously known for use in ventilation systems generally have a valve casing which is provided with a seat resembling a truncated cone. A similarly designed valve body cooperates with the seat, but has smaller dimensions so that the air passage through the seat more or less assumes the shape of a slot with a large crescent-like cross section. In a commonly used valve, the valve body is mounted onto the seat by means of a self-tapping screw. Adjustment is afforded by providing a slot in the seat through which the screw passes so that when the screw is loose the valve body may be adjusted along the slot and then tightened in the desired position before the valve casing is mounted in the exhaust passage. In another valve which is commonly used, the valve body is rotatably mounted in registry with the seat and is held in adjusted position by friction. Other arrangements for anchoring and installing valve bodies are also known.

Conventional valve structures of this type are advantageous in many respects, but in view of the considerable period of time which has elapsed since they were first conceived, various new requirements have been imposed relating to the various functions and characteristics of an exhaust air valve. For example there is currently a high requirement for low generation of noise in ventilating systems at normal operating positions and under all normal operating conditions, and in certain cases, the ventilating system must be noiseless at a certain special operating position or under a certain special operating condition.

Capability of variable adjustment is another requisite, and in many cases full adjustment between maximum opening and complete closing of the ventilation passages is required. Preferably the adjustability should be achieved through simple and secure fastening of the valve body. Desirably the adjustment may be accomplished manually and the adjusted position should be secured by simple frictional resistance. The valve operator may comprise a cord or the like for manual adjustment and may also embody an automatic anti-fire tripping mechanism which automatically closes the valve at higher temperatures.

It is desirable that the valve casing and/or the valve body are readily adapted to different environments and should be compact. The valve should have long operating life and be resistant to jamming or other frictional problems under all conditions and yet be lightweight and simple, and inexpensive to manufacture, install and adjust. Adaptation of the valve to special purposes should be easily accomplished in a simple manner. Last, but not least, the valve should be attractive in appearance since it is frequently completely exposed to view in an apartment or a home.

SUMMARY OF THE INVENTION

A principle object of the present invention is to achieve all of the above-stated characteristics and functions and in addition to contribute in several respects to technical advancement in the ventilation technology, introducing in many respects an attractive and desirable product.

In accordance with the invention, the objective of the invention is achieved by providing a valve having a valve seat converging in the direction of flow, the upstream surface of the valve seat being concave so as to be in continuous sealing contact with the convex surface of the valve element, the surfaces having the same center of curvature to permit rotary or longitudinal sliding displacement of the valve body element along the confronting surfaces between its open and closed positions.

It has been found in prototypes of valves made in accordance with the present invention that exhaust valves in which the upstream side of the valve body is convex and complementary to the downstream side provide a low generation of noise while obtaining the other desirable characteristics.

BRIEF DESCRIPTION OF THE DRAWINGS

All of the objects of the invention and the operation of the various embodiments are more fully set forth in the following description in connection with the accompanying drawings which show several preferred, but non-limiting embodiments, and wherein.

In the drawings, the same or similar parts are designated by the same reference characters with a designator identifying the particular embodiment.

DESCRIPTION OF THE PREFERRED EMBODIMENTS

Figure 1:
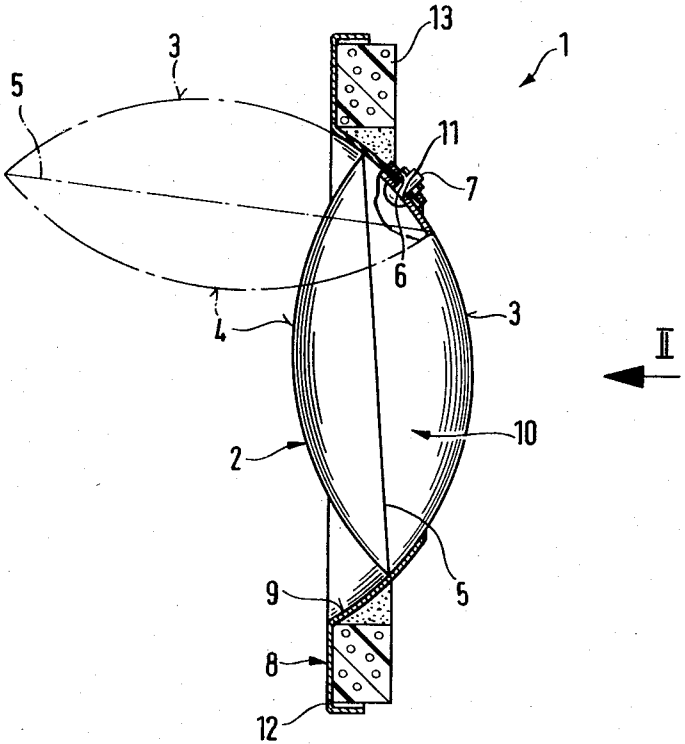
FIG. 1 illustrates a first embodiment of an exhaust air valve according to the present invention, showing the casing and seat element in axial cross section, the valve body element being illustrated in full lines with a part broken away and in completely closed position, the fully open position being shown in broken lines.

In accordance with the invention, the exhaust air valve 1 comprises a valve body 2 and a valve casing 8. The casing provides a valve seat element with a seat surface 9 having a central opening defining a flow passage orifice 10 for spent air which is to be sucked out of or forced from a space to be ventilated. The valve body element 2 has a sealing surface 3 confronting a cooperating with the surface 9 of the seat element.

Figure 2:
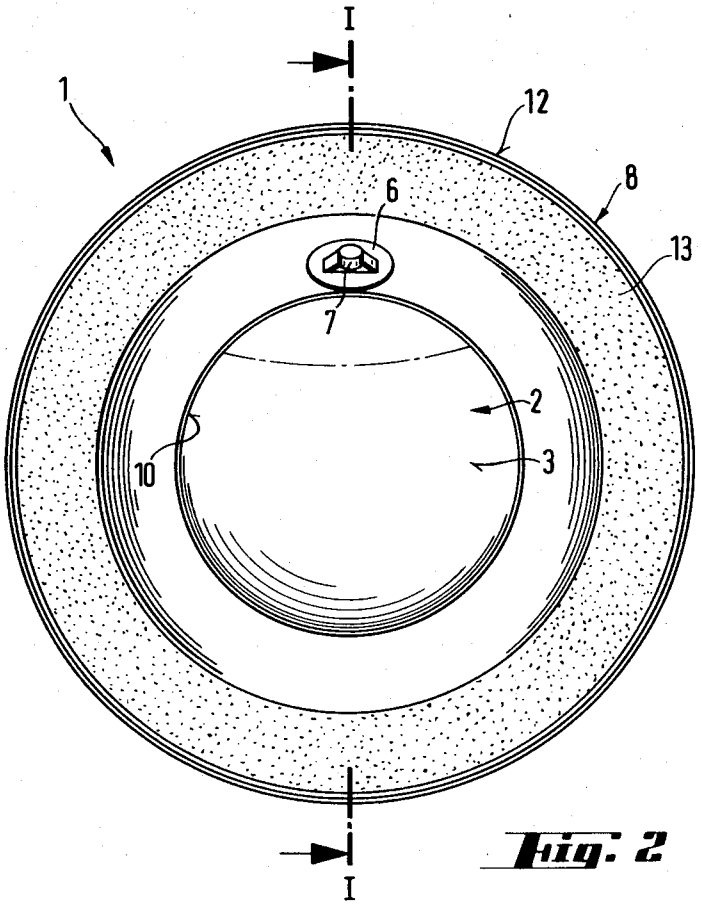
FIG. 2 is a rear elevation of the valve shown in FIG. 1.
Figure 1A:
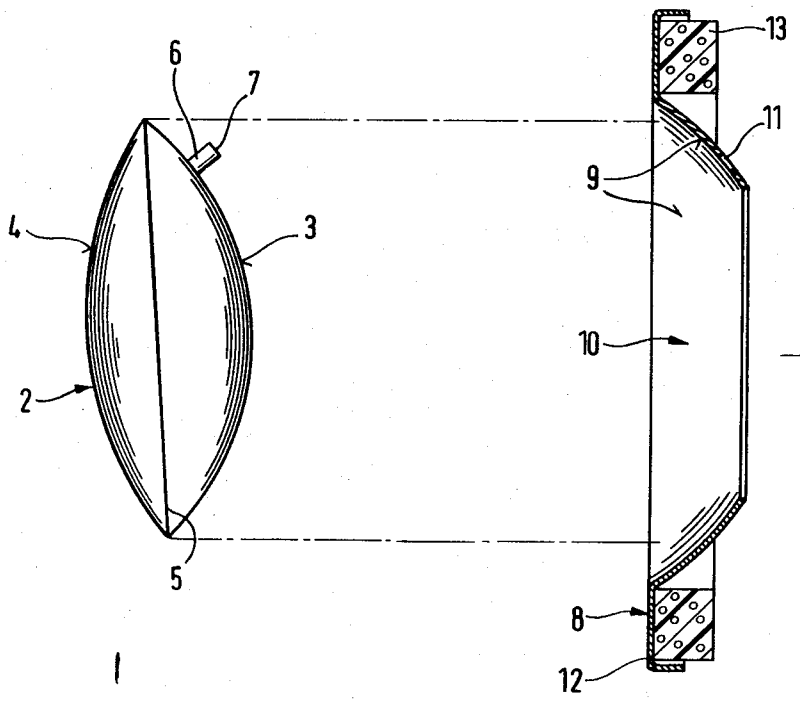
FIG. 1*a* illustrates the valve of FIG. 1 in exploded format.
Figure 11:
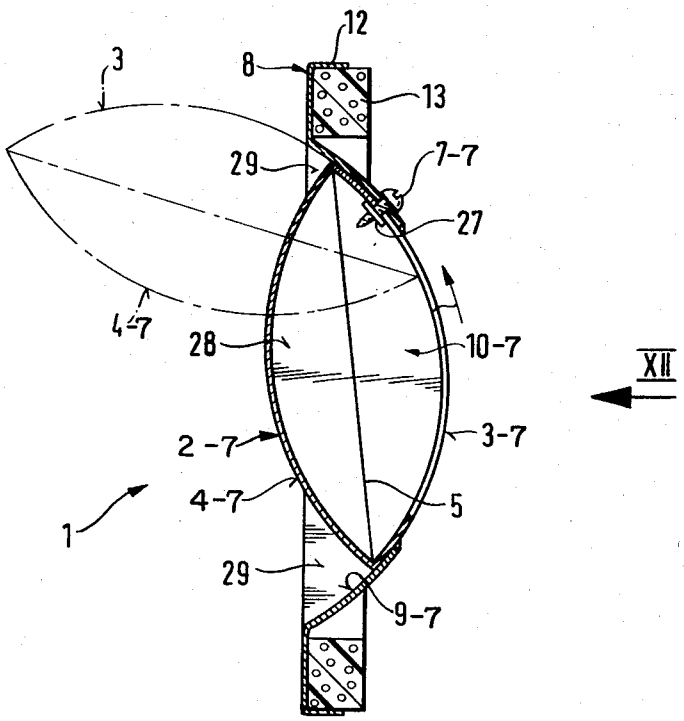
FIG. 11 is a view similar to FIG. 1 illustrating a seventh embodiment of the invention.
Figure 12:
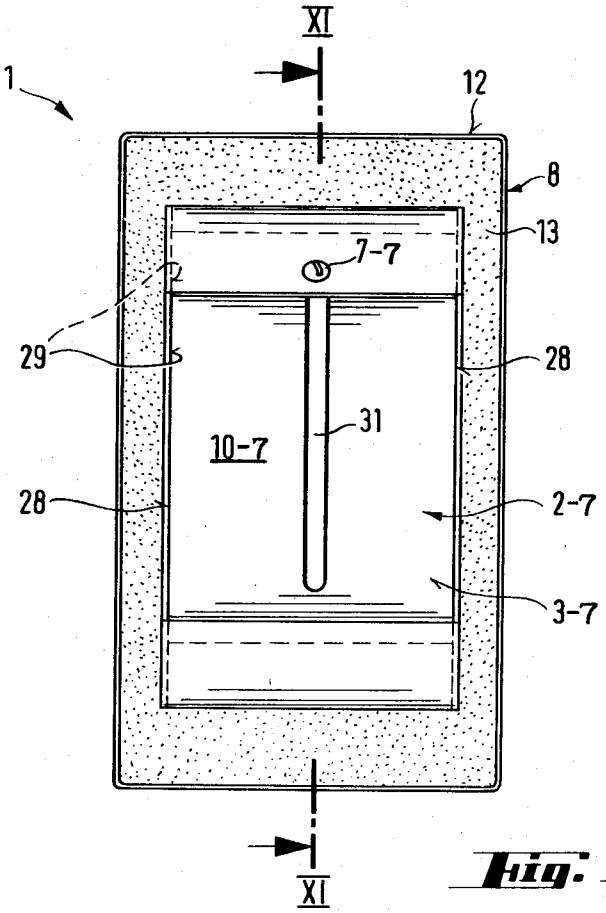
FIG. 12 is a rear elevation of the valve of FIG. 11 as seen from the right.

In the embodiment illustrated in FIGS. 1–2 as with all of the other embodiments except the embodiment of FIGS. 11 and 12, the valve body 2 consists of two partial spheres which face in opposite directions so that the downstream surface 3 of the valve body element constitutes a sealing surface 3 while the opposite upstream surface constitutes an intake guide surface 4 for directing air flowing towards the orifice 10.

Both of the partial spheres may be formed of metal and/or plastic and they are connected to one another along the periphery 5 by gluing, welding or by formed joints which may be folded together or snapped together. The spherical parts are in the form of a spherical segment with a single base. The bases are interconnected along the periphery 5 and in the present instance form a sharp line of juncture. This junction line may be rounded or folded or designed in another manner, if desired.

The valve seat 9 likewise is in the form of a spherical segment, but in this case the formation is a spherical segment with two bases. The larger base faces upstream and may be coplanar with an outwardly extending flange 12 which terminates in a downturned lip for enclosing a sealing ring or gasket 13. The smaller base of the spherical segment forming the seat 9 defines the orifice 10. The spherical segment embraced by the larger base is no greater than 180° so that the seat surface becomes narrower and converges from the larger base towards the smaller base in the direction of flow through the orifice 10. The larger base is preferably equal to or less than the diameter of the ventilation conduit, and the smaller base has a diameter less than the diameter at the periphery 5 of the bases of the spherical segments forming the valve body 2. As is apparent, when the valve body 2 closes the orifice 10, the base or periphery 5 of the valve body element surrounds the orifice 10 defined by the base of the seat element segment and fully closes the orifice. As the body element 2 is slid along the spherical surfaces 3 and 9, the base 5 of the valve body element surface 3 intersects the base of the seat element surface 9 and opens a passageway through the orifice 10 in the shape of a lune. Further displacement increases the size of the lune-shaped opening until the base 5 of the valve body element 2 passes out of registry with the smaller base of the valve seat element, at which point the valve seat orifice 10 is fully open.

The opening and closing movement of the valve body on the seat is accomplished while maintaining the valve body surface 3 in engagement with the seat surface 9 at all times. In this way, the sliding displacement between the valve body sealing surface 3 and the valve seat surface 9 prevents dirt or other foreign matter from lodging between these elements and preventing complete closure of the valve.

As shown in FIGS. 1 and 2, the valve body element is retained in engagement with the valve seat element by engagement means in the form of an anchoring member 7 having a head bearing against the inside of the valve body and a shank projecting perpendicular to the spherical surface 3 through an aperture 11 in the surface 9 of the valve seat element. Retention of the elements in engagement is ensured by a retaining washer 6 or other retainer or bearing element which permits the valve body 10 to pivot about the pivotal shaft 7.

In a given example, the valve casing 8 is mounted over the ventilation opening of a ventilation conduit. If the conduit has a diameter of 100 mm, the sealing surface 3 of the valve body element has a radius of curvature of 55 mm and the opposite guide surface 4 has a radius of 66 mm, in the present case an approximately 20% greater radius of curvature than the sealing surface 3. This greater radius of curvature results in a desirable guidance or direction of the inwardly flowing air through the valve with a low generation of noise. The flow passage orifice 10 defined by the smaller base of the seat surface segment 9 has a diameter of 70 mm while the larger base of the surface segment defining the seat 9 has a diameter approximately the same size as the ventilation channel. The radius and center of curvature of the sealing surface 3 are substantially the same as the center and radius of curvature of the seat surface 9 so that these surfaces are free to slide along one another along the surfaces and about their common center of curvature.

As shown in FIG. 1, when the valve is closed the pivot member 7 is approximately 6 mm from the base of the spherical segment defining the orifice 10. Since the diameter of the valve body at the periphery 5 of the spherical segments is approximately 88 mm, the body is securely nested in the cavity formed by the valve seat surface 9, with the base 5 of the spherical segments of the valve body being midway between the smaller and larger bases of the spherical segment forming the seat. The axis of the pivot member 7 is only slightly greater than 45° offset from the plane of the base along the periphery 5 so that rotary displacement of the valve body 2 on the pivot 7 through 180° positions the periphery 5 in the fully open position slightly greater than 90° from the plane of the periphery 5 in the closed position. Altering the angle of the pivot element 7 relative to the base or periphery 5 of the valve body changes the angle of the base or periphery 5 between the opened and closed positions. Altering the position of the pivot opening 11 in the surface 9 changes the inclination of the base 5 relative to the plane of the orifice 10.

With reference to FIG. 1 it should be noted that the configuration of the valve body produced a minimum of resistance to the incoming air flow and does not present any real obstacle to the flow of air through the passage, but instead directs the air around the valve body substantially without any production of whirls or turbulance which otherwise will produce a high generation of noise in the valve. This is true both in the fully opened position shown in broken lines in FIG. 1 and in the partly opened positions between the respective opened and closed positions shown in FIG. 1. The double-spherical-segment shape of the valve body directs the flow through the orifice without any appreciable throttling effect by the valve body element itself. Furthermore the configuration avoids turbulance in the air flow downstream of the valve, where otherwise noticable vibrations may arise. The greater radius of curvature on the guide surface 4 of the valve body contributes in a high degree to the good air flow guidance characteristics of the valve body. The curvature of the guidance surface deflects the incoming air in a fashion which reduces the tendency to generate cross currents across the air flow so that the risk of generating turbulance is negligable.

It is apparent that the exposure of the valve body element to view externally of the ventilation conduit is not disadvantageous in view of the favorable appearance provided by the configuration of the present invention. The valve body is readily manipulated to the desired setting with minimum difficulty. The adjustment of the valve body may be facilitated by a suitable scale or other indicia on the front and/or the rear side of the valve seat surface or even on the flange 12 or the area of the junction of the flange with the seat surface in the valve seat. The valve body element of FIG. 1 can be pivoted through 360° about the pivot shaft 7 of the engaging means without limitation, and thus if indicia is provided, it may be provide for a full 360° of operation. The full adjustability provides the additional advantage of enabling two alternate settings for every position between fully opened and fully closed, and the alternate positions may be of advantage during installation, and may also make adjustment easier and improve the aesthetics of the device. In general, the valve should be able to be mounted at any selected angle, or "hour" position relative to the flange 12 as a dial, and the engaging means enables the anchoring of the valve body in any such position, so that in this way a wide choice of a position is available. As evidenced in FIG. 1, the valve, when closed, occupies a minimum space and therefore may be packaged and stored without any difficulty. As noted above, the operation of the valve maintains the seating surface clean and free of foreign matter and the entire configuration renders the valve easy to clean and practically maintenance-free. In connection with the flow through the valve, the configuration of the valve body is of greater significance in the partially-opened positions. The double-spherical-segment configuration of the valve body minimizes upsetting of the air flowing through the valve orifice and the converging character of the valve seat surface cooperates with the configuration of the valve body to direct the incoming air towards the center of the ventilation channel, minimizing turbulance.

In all of the illustrated embodiments the seat surface and the sealing surface are congruent, but is should be mentioned that it is not necessary that the entire surface be congruent but only that the surfaces have a common curvature and a common center of curvature along a line surrounding the orifice provided by the smaller base of the seat surface. Likewise, the guide surface 4 is shown as a continuous spherical segment with a single base, but it may be truncated to provide a flattened portion or may be provided with a hand-hold depression or projection in or on the surface to facilitate manipulation of the valve body.

Figure 3:
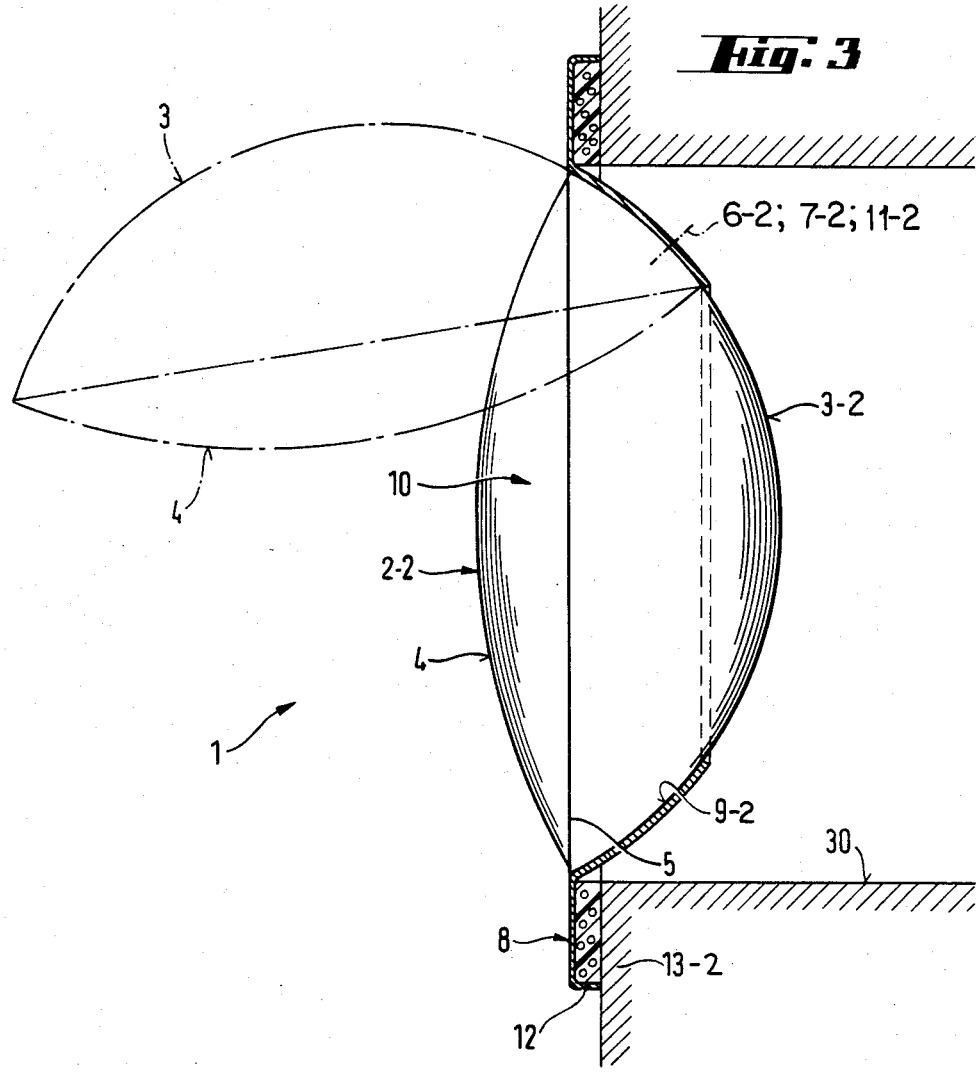
FIG. 3 is view similar to FIG. 1 illustrating a different embodiment of the invention, showing the casing installed in the exhaust opening of a ventilation conduit.
Figure 4:
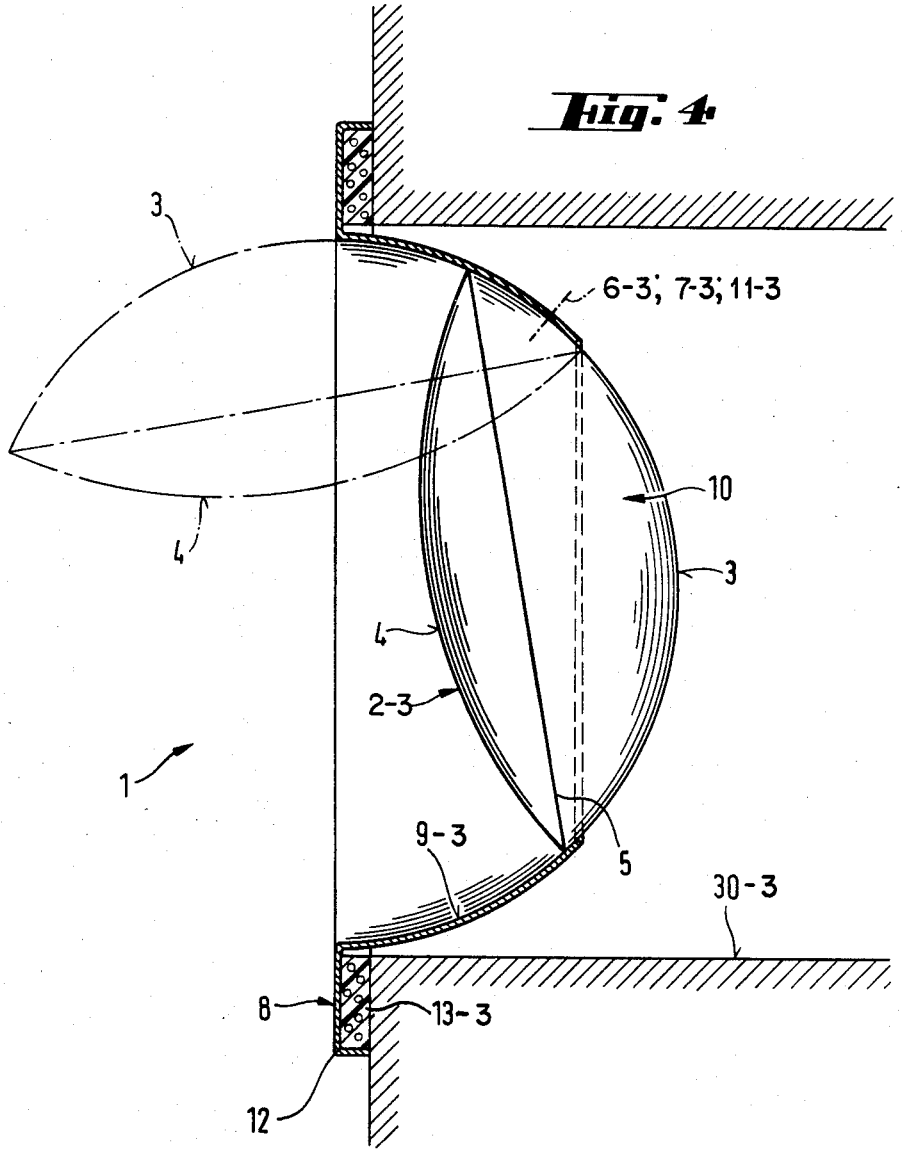
FIG. 4 is a view similar to FIG. 3 illustrating a third embodiment of the invention.

FIGS. 3 and 4 show second and third embodiments of the valve mounted in the exhaust opening of a ventilation channel 30. When mounted, the sealing rings 13-2 and 13-3 tend to compress against the flange 12 and in each case the diameter of the larger base of the spherical segment forming the respective seats 9-2 and 9-3 corresponds closely to the diameter of the ventilation conduit 30. In the second embodiment shown in FIG. 3, the sealing surface 3-2 of the valve body 2-2 has the same radius of curvature as the surface 9-2 of the seat element. The height of the spherical segment forming the seat 9-2 is greater than the height of the segment of the first embodiment shown in FIGS. 1–2. This permits greater freedom of choice in designing respectively the seat element 9-2 and the valve body element 2-2.

The engaging means for retaining the valve body element in engagement with the seat element may take different forms. For example, as indicated by the broken lines 7-2 and 11-2 in FIG. 3, in the second embodiment, the valve body is maintained in engagement with the seat by magnetic force only. In this case a magnet 7-2 is in the valve body and a complimentary magnet 11-2 is on the backside of the casing. Since the material of the seat and the valve body is a magnetic material, only a single magnet may be needed. In FIG. 4 a different form of engaging means is indicated schematically by the broken lines at 6-3, 7-3 and 11-3. In this case there is a pivot member 7-3 which passes through an elongated slot 11-3 in the valve seat and the engagement is secured by a keeper member 6-3 similar to those illustrated in FIGS. 1 and 2. The use of an elongated slot extending parallel to the direction of flow through the valve orifice permits the pivot position to be adjusted to varying degrees of offset from the center line of the ventilation conduit 30-3 in FIG. 4. In other respects the embodiment of FIG. 4 utilizes a valve body similar to that shown in FIG. 3, but is smaller relative to the seat so that the body 2-3 in FIG. 4 nests closer to the orifice than does the valve body 2-2 in FIG. 3.

Figure 5:
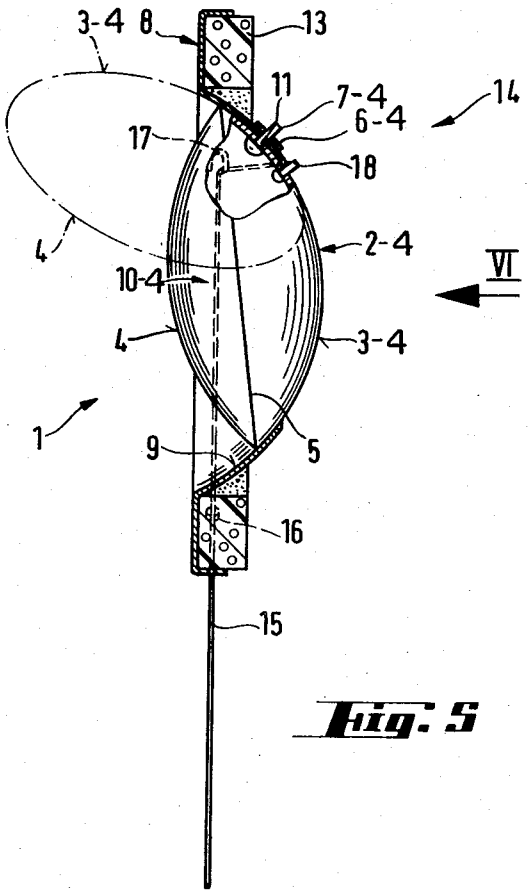
FIG. 5 is a view similar to FIG. 1 illustrating a fourth embodiment of the invention.
Figure 6:
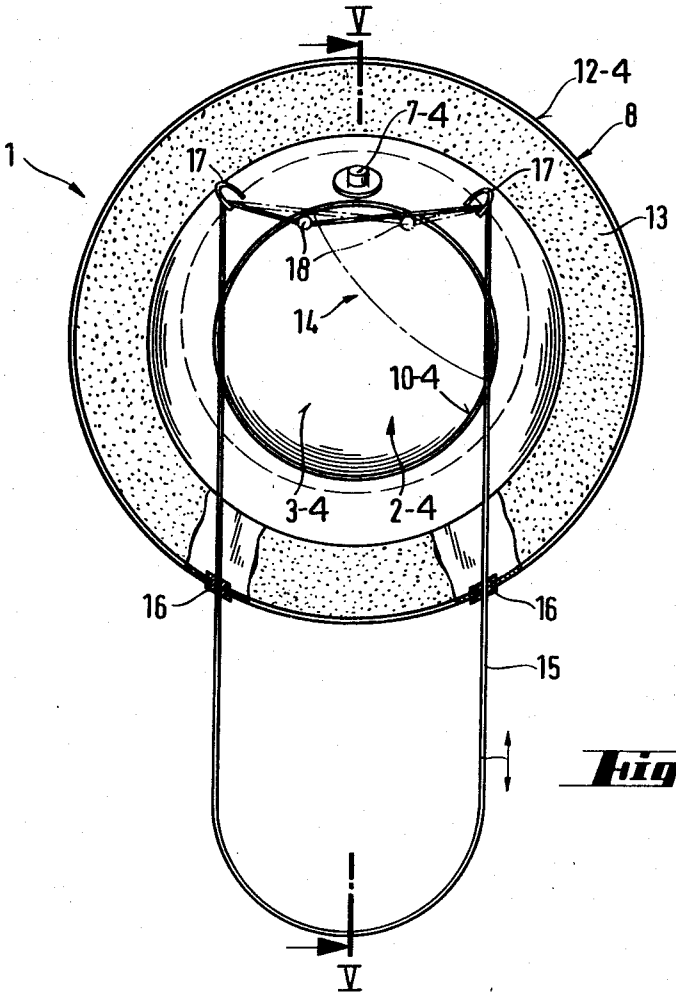
FIG. 6 is a rear view of the valve of FIG. 5.

As indicated above, the valve bodies of the first three embodiments may be manipulated manually to position them properly on the seat. Operators may be provided to adjust the position of the valve element and, to this end, FIGS. 5 and 6 illustrate a fourth embodiment in which a valve operator assembly 14 consists of a cord or similar tension element 15 which is threaded through guide holes 16 in the edge of the flange 12-4 to extend to opposite sides of the pivot shaft 7-4 of the engaging means of the valve. Guide eyelets 17 are provided on opposite sides of the pivot members 7-4 and the cord passes through the eyelets to a mounting stud 18 on the downstream side of the valve body element 2-4. The stud 18 is positioned within the orifice 10-4 and may bear against the edge of the seat in both the fully opened position and the fully closed position. The position of the stud 18 on the sealing surface 3-4 determines the fully opened position and the stud cooperates with the edge of the orifice to serve as a stop abutment means limiting the displacement of the valve body element 2-4. The opposite ends of the cord 15 are connected to the stud 18 so that by extending and retracting the cord the valve body element may be displaced from its fully closed position to its fully opened position and may be stopped at any point in between.

Figure 7:
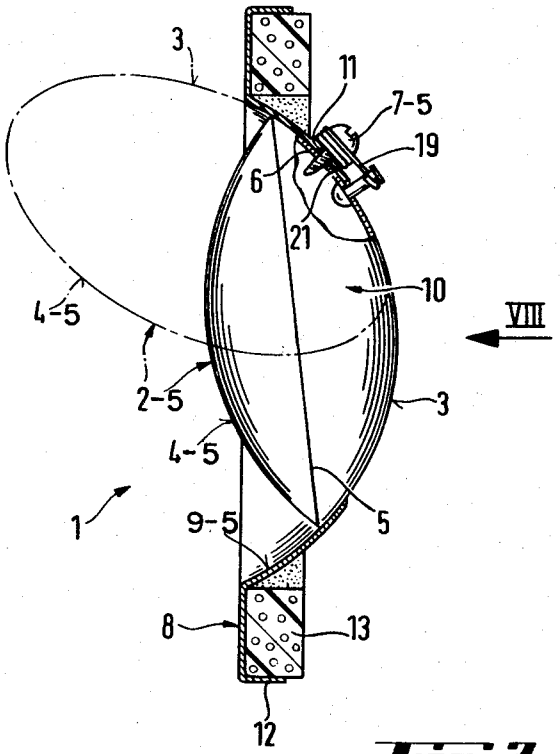
FIG. 7 is a view similar to FIG. 1 illustrating a fifth embodiment of the invention.
Figure 8:
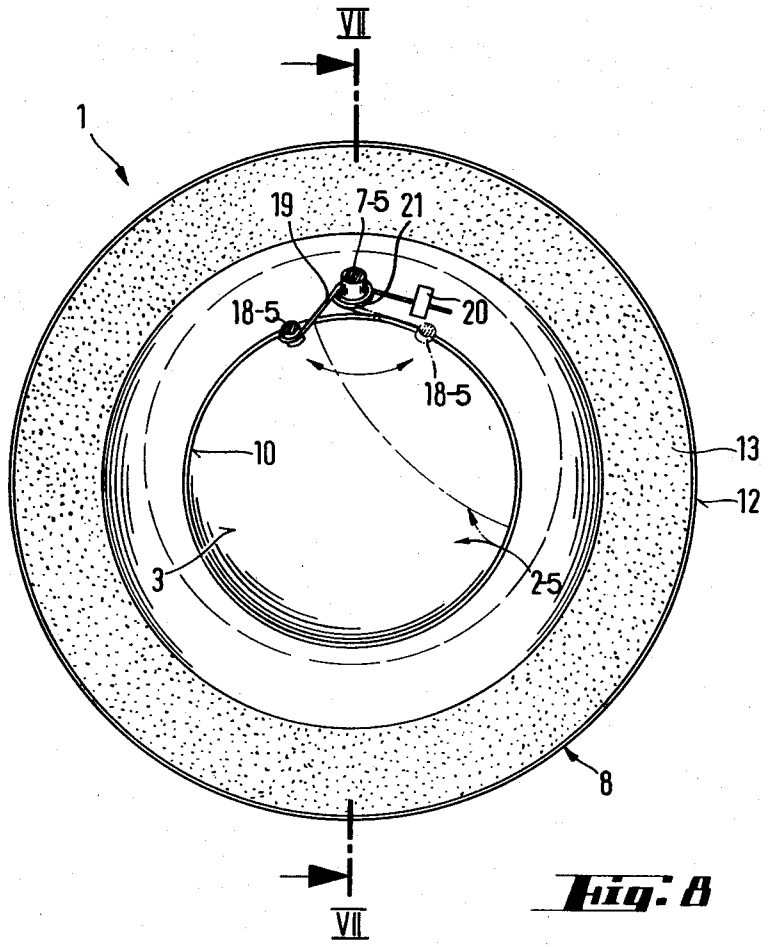
FIG. 8 is a rear elevation of the valve of FIG. 7.

In FIGS. 7 and 8 a fifth embodiment of the exhaust air valve is shown. It is noted that the spherical surface segments 2-5, 4-5 and 9-5 all have the same radius of curvature. In this embodiment the studs 18-5 are positioned similarly to the studs 18 of the fourth embodiment, and an anti-fire tripping device is provided to automatically close the valve, for example when the ambient temperature in the vicinity of the valve exceeds a predetermined safe level. To effect automatic closure of the valve body 2-5 a spiral spring 19 is positioned over the shaft 7-5 of the engaging member on the downstream side of the valve seat surface 9-5. One leg of the spring 19 is attached to the stud 18-5 and the other leg is attached to a mounting lug 20 on the seat 9-5. In a valve of this type, the valve body is normally set in open position, as indicated in broken lines in FIGS. 7 and 8 at 2-5. A fusible link or washer 21 extends between the legs of the spring which is in tension in the compressed position shown in broken lines in FIG. 8 and the link holds the spring locked in tension. If the ambient temperature exceeds a preset limit, for example 70° C., the link melts, releasing the spring and causing the spring to displace the valve body 2-5 into the closed position. Of course other forms of securing and heat-sensitive tripping mechanisms may be used to provide the anti-fire damper function.

Figure 9:
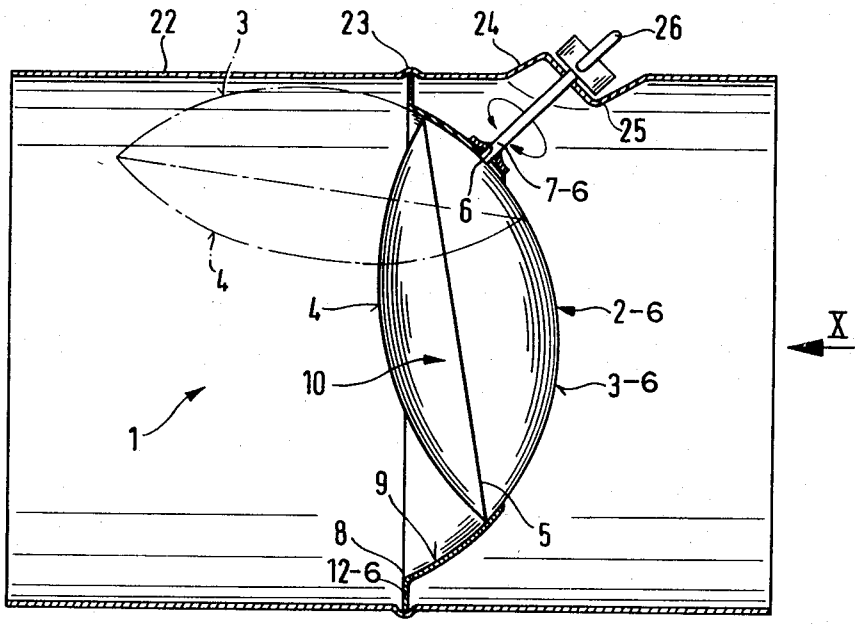
FIG. 9 is a view similar to FIG. 3 illustrating a sixth embodiment of the invention, showing the casing installed within a conduit.
Figure 10:
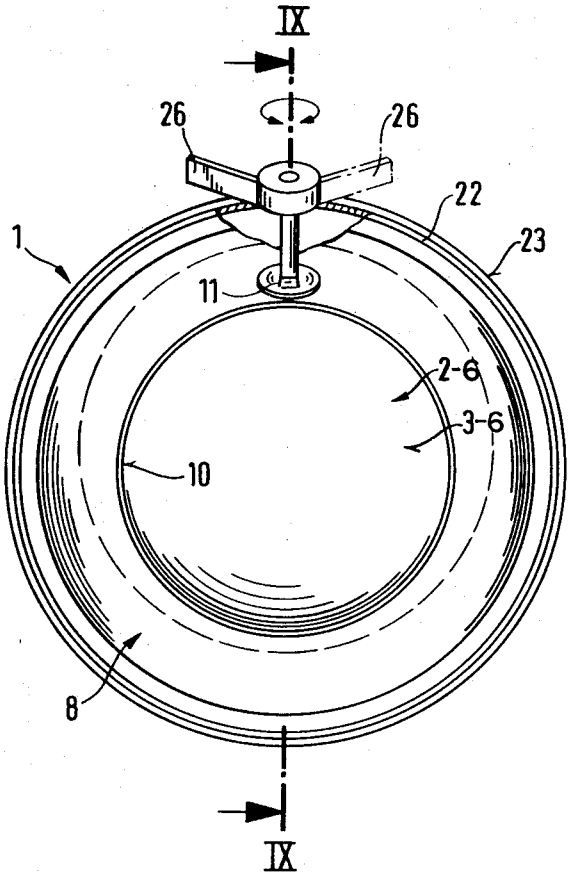
FIG. 10 is a rear elevation of the valve of FIG. 9 as seen from the right, with a part of the conduit broken away.

FIGS. 9 and 10 illustrate a sixth embodiment in which the valve is positioned easily within a ventilation conduit 22. In this case the flange 12-6 of the valve casing is secured in a circumferential groove 23 in the conduit. Thus the flange and the entire valve assembly is diametrically arranged in the conduit. In order to enable adjustment of the valve, a pivotal shaft 7-6 extends outwardly through the conduit wall and to facilitate passage of the shaft through the wall it is upset as indicated to provide an elevation 24 and a depression 25 having a seat between them for journalling the shaft 7-6 on which an operating lever 26 is mounted. As shown in FIG. 10, the operating lever 26 is displaceable to open and close the valve. With reference to FIG. 9, it is noted that when the valve body 2-6 is in its fully opened position, the convex shape of the sealing surface 3-6 is able to nest within the cylindrical contour of the conduit 22, effecting an efficient use of the space within the conduit.

A seventh embodiment is illustrated in FIGS. 11 and 12, and this embodiment is particularly adapted to an installation where the spherical form of valve body element is not suitable. In this case, the valve seat element 9-7 is not spherical but rather is cylindrical and has flat end walls 29 at the opposite ends. The valve body element 2-7 is likewise formed by a sector of a cylinder providing a convex sealing surface 3-7 on one side and a complimentary covex cylindrical sector providing a guiding surface 4-7 on the opposite side. It should be noted that the surface 9-7 of the seating element comprises a cylindrical segment of a width no greater than 180° and is interrupted to provide an orifice 10-7 with a width smaller than the width of the valve body surface segment 3-7. In the closed position shown in full lines, the sealing surface bridges the orifice and closes the valve, and when slidingly shifted along the cylindrical surface to the open position shown in broken lines, the orifice is opened. In this case the movement of the valve body is guided by a keeper screw 7-7 which penetrates through the seating surface 9-7 and through an elongated slot 31 in the sealing surface 3-7 of the valve body element. Inside the body element a washer 27 or other bearing element retains the valve body element in sliding engagement with the seat element. The displacement of the valve element body is limited by the extent of the slot in the valve body element. While the illustrated keeper means comprises a screw 7—7 and bearing member 27, other engaging means are possible. Spring clip fasteners may be used with good effect so that the resilience of the fastener permits adjustment of the valve and yet retains the valve body in adjusted position by the spring force generating frictional force. Alternatively the flat end surfaces of the valve element and the valve seat may be designed to provide a complementary interlock which frictionally affords the aforesaid adjustment between opened and closed position so that no special engaging means is required.

Although this embodiment of the invention does not possess the symmetry of the spherical configurations discussed in connection with the previous embodiments, it employs similar operating functions and achieves many of the desirable characteristics of the previous embodiments.

Figure 13:
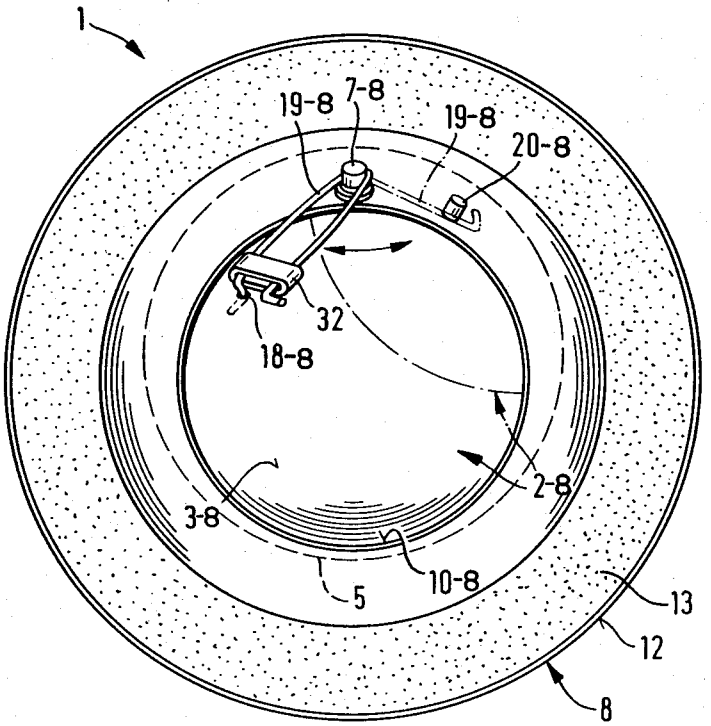
FIG. 13 is a view similar to FIG. 2 illustrating an eighth embodiment of the invention having an automatic tripping mechanism for closing the valve in the event of a fire.

FIGS. 13 through 16 illustrate valves having temperature responsive tripping devices for automatically closing the valves in the event of a increase in ambient temperature above a preset limit. In FIG. 13, the valve element 2-8 is pivoted to the valve seat adjacent the orifice 10-8 by a stud 7-8. A helical spring 19-8 is mounted on the stud and one leg of the spring is anchored to the valve element by passing through a hole 18-8 on the sealing surface 3-8. The other leg of the spring 19-8 is latched in tensioned condition to the first leg by a fusible clip 32 which is a heat-sensitive member which maintains the spring in tension until such time as a preset temperature is exceeded. With this arrangement, the valve body may be positioned at any desired position between the closed position shown in full lines and the open position shown in broken lines in FIG. 13 at 2-8. If the ambient temperature exceeds the fusing point of the clip 32, the clip releases the tension in the spring and it springs to the broken-line position shown at 19-8 to bear against the holding means 20-8 and the spring pressure pivots the valve element 2-8 to its closed position. This embodiment permits the valve element to be adjusted at any desired position of openness, and the spring will be of no effect until such time as the fusible clip is activated.

Figure 14:
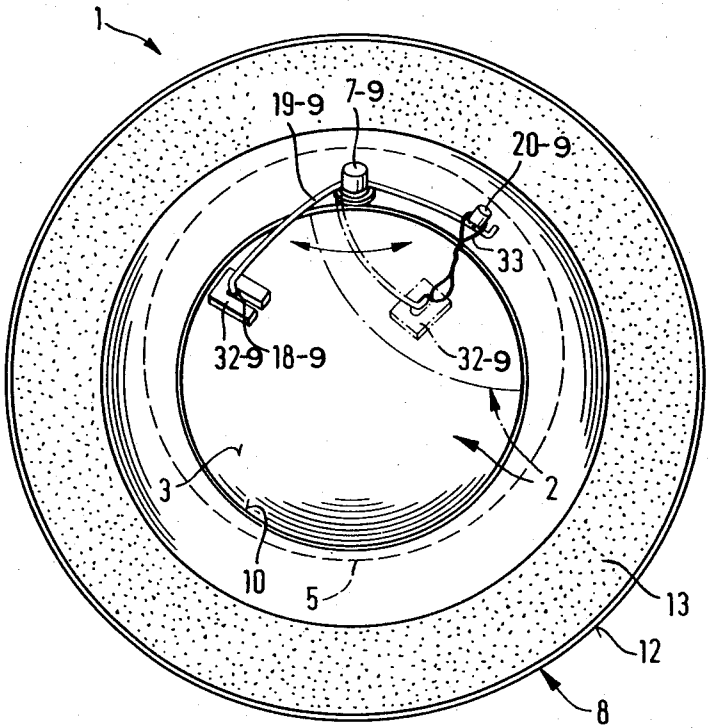
FIGS. 14 through 16 inclusive are views similar to FIG. 13 showing alternate forms of tripping mechanism.

A different tripping arrangement is illustrated in FIG. 14. In this embodiment, a spring 19-9 is mounted on a shaft 7-9 and one end is anchored in the valve body through a hole 18-9 and the other end bears against the holding means 20-9. To open the valve from the closed position shown in full lines, the spring is compressed as shown in broken lines and a connector 33 connects a fusible clip 32-9 to the holding means 20-9 to maintain the spring under tension. When the clip is activated, the heat-sensitive clip releases the tension in the spring 19-9 to close the valve to its full-line position.

Figure 15:
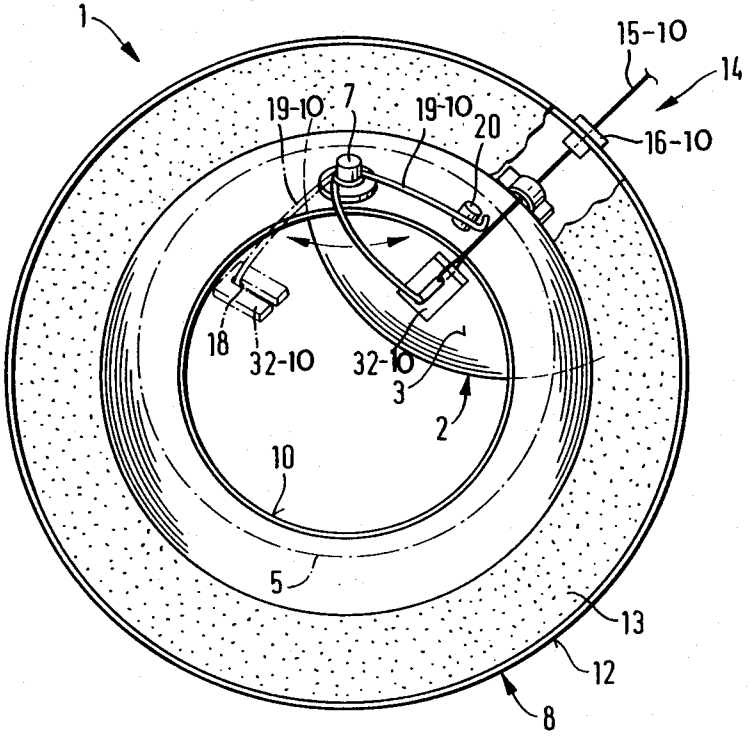

FIG. 15 illustrates a further embodiment similar to FIG. 14, but in which the spring is tensioned by a cord 15-10 and clip 32-10. The cord 15-10 passes through guide means 16-10 in the casing so as to enable adjustment of the valve position by manipulation of the cord. In the event of excessive temperature, the fusible clip disconnects the cord from the spring 19-10 and enables the spring to close the valve.

Figure 16:
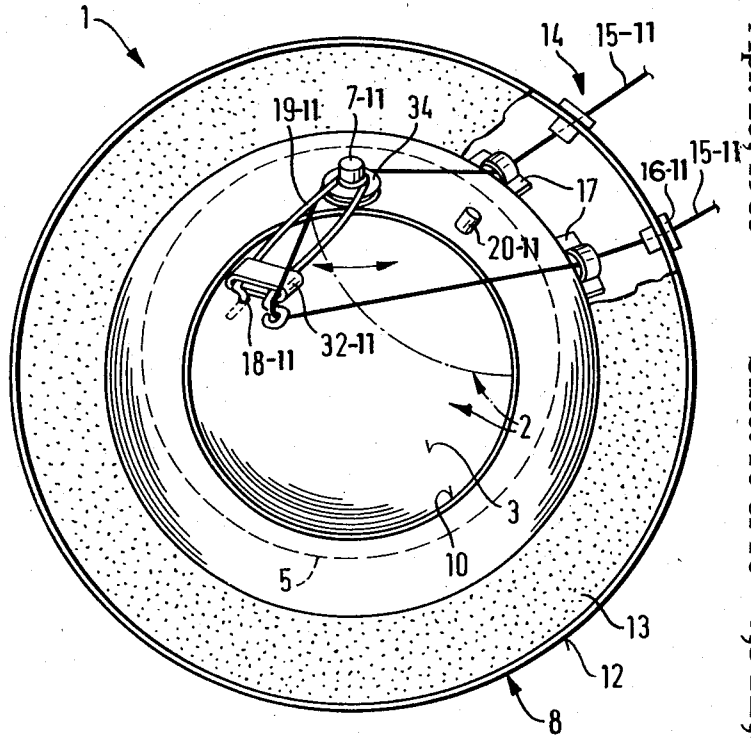

FIG. 16 shows an embodiment similar to FIG. 13 of having an operator to position the valve at any desired location. To this end the spring 19-11 is maintained in tension by a fuse-metal clip 32-11. One leg of the spring 19-11 is engaged in a hole 18-11 in the valve body element and the other leg of the spring 19-11 is positioned to engage against the holding means 20-11 when the clip 32-11 is released. A cord 15-11 extends through guides 16-11 in the casing and extends around a pully 34 journalled on the shaft 7-11. The ends of the cord are secured to the valve body sealing surface 3-11 so that the desired position of the valve may be simply achieved by manipulation of the cord enabling adjustment of the valve between opened and closed positions and to any position therebetween. Thus the valve is readily adjustable by remote control and yet is provided with tripping mechanism to automatically close in the event of fire.

While particular embodiments of the present invention have been herein illustrated and described it is not intended to limit the invention to such disclosure but changes and modifications may be made therein and thereto within the scope of the following claims.

I claim:

1. A valve for a ventilation channel comprising a valve casing with a valve seat element defining a flow passage orifice for air which is to be sucked out of or forced from a space, said valve seat element becoming narrower and converging in the direction of flow through the flow passage orifice, a valve body element cooperable with the upstream surface of the valve seat element and selectively operable for opening and closing the flow passage, the confronting surfaces of the valve seat element and the valve body element engaging each other along at least a line contact surrounding said orifice when the valve is closed, and being concave and convex respectively with the same center of curvature, characterized in that the confronting surfaces of the valve seat element and the valve body element comprise surface segments having the same radius of curvature and an arcuate extension no greater than 180 degrees, the surface segment of the seat element having an orifice with a width smaller than the width of the valve body surface segment, said valve body element being selectively slidable along one of said confronting surface segments between its open and closed positions, in the open position said body element being out of registry with said orifice to open a flow passage therethrough, and in closed position said body element covering said orifice to close the flow passage therethrough, said valve including engagement means to maintain the surface segment of said valve body element in sliding engagement with the surface segment of said seat element throughout said opening and closing displacements of said valve body element.

2. A valve for a ventilation channel comprising a valve casing with a valve seat element defining a flow passage orifice for air which is to be sucked out of or forced from a space, said valve seat element becoming narrower and converging in the direction of flow through the flow passage orifice, a valve body element cooperable with the upstream surface of the valve seat element and selectively operable for opening and closing the flow passage, the confronting surfaces of the valve seat element and the valve body element engaging each other along at least a line contact surrounding said orifice when the valve is closed, and being concave and convex respectively with the same center of curvature at least along said line of contact, characterized in that the confronting surfaces of the valve seat element and valve body element comprise spherical segments of the same radius of curvature, each having at least one base, the base of the seat segment defining the orifice of said seat element and the base of said body segment defining the outer periphery of said body element, said valve body element being selectively slidable along said confronting surfaces between its open and closed positions, in the open position said bases intersecting one another to provide a flow passage in the shape of a lune, and in the closed position the base of the body segment surrounding the base of the seat segment without intersecting the same, said valve including engagement means to maintain the spherical segment of said valve body element in sliding engagement with the spherical segment of said seat element throughout said opening and closing displacements of said valve body element.

3. A valve for a ventilation channel comprising a valve casing with a valve seat element defining a flow passage orifice for air which is to be sucked out of or forced from a space, said valve seat element becoming narrower and converging in the direction of flow through the flow passage orifice, a valve body element cooperable with the upstream surface of the valve seat element and selectively operable for opening and closing the flow passage, the seat surface of the valve seat element confronting the sealing surface of the valve body element, said surfaces being curved and engaging each other along at least a line contact surrounding said orifice when the valve is closed, and being concave and convex respectively with the same center of curvature and the same radius of curvature at least along said line of contact, characterized in that said valve body element is selectively slidable along one of said confronting surfaces between its open and closed positions, said valve including engagement means to maintain the curved surface of said valve body element in sliding engagement with the curved surface of said seat element throughout said opening and closing displacements of said valve body element, and said body element having a convex guiding surface opposite to said confronting sealing surface to provide a guiding surface facing the flow of air through said seat orifice when said valve is open.

4. A valve according to claim 3 wherein said convex guiding surface of the valve element has a radius of curvature equal to the radius of curvature of the confronting sealing surface.

5. A valve according to claim 3 wherein said convex guiding surface of the valve element has a radius of curvature greater than the confronting sealing surface.

6. A valve according to claims 1 or 2 wherein said valve body element has a convex guiding surface opposite to said confronting surface to provide a convex surface facing the flow of air through said seat orifice when said valve is open.

7. A valve according to claim 1 or 3 wherein said engagement means comprises a magnet member mounted on at least one of said elements, the other of said elements including a magnetic material effective to maintain said elements in engagement while permitting relative sliding displacement therebetween.

8. A valve according to claim 1 or 3 wherein said engagement means comprises a slot in one of said elements and a keeper on the other of said elements, said keeper passing through said slot and having a bearing portion engaging said one element on opposite sides of said slot to afford relative sliding displacement of said one element along the length of said slot.

9. A valve according to claims 1, 2 or 3 wherein said engagement means includes open and closed stop abutment means defining an open position and a closed position, said engagement means affording displacement of said body element between said positions.

10. A valve according to claim 9 wherein said engagement means includes a valve operator for displacing said body element between said positions.

11. A valve according to claim 10 wherein said valve operator comprises cord means coupled to said body element, and guide means on said seat element to effect said displacement of the body element upon extension or retraction of said cord means.

12. A valve according to claim 10 wherein said valve operator comprises a spring device urging said body element toward said closed position, and a heat-sensitive member rendering said spring device inoperative when the ambient temperature is below a predetermined temperature level.

13. A valve according to claim 12 wherein said heat-sensitive member is a fusible link or clip.

14. A valve according to claim 2 or 3 wherein said engagement means comprises a pivot member having an axis offset from the center line of said opening and passing through the center of curvature of said confronting surfaces and interconnecting said elements for relative pivotal sliding movement about the axis of the pivot member.

15. A valve according to claim 14 wherein said pivot axis is offset approximately 45° from the center line of said opening.

16. A valve according to claim 14 wherein said pivot member is fixed to said valve body element and serves as a valve operator for the valve.

* * * * *